United States Patent [19]

Mitchell

[11] 4,206,693

[45] Jun. 10, 1980

[54] CHIMNEY COWLS

[76] Inventor: Arthur W. Mitchell, Kilkeel County Down, Kilkel County Down, Northern Ireland

[21] Appl. No.: 942,914

[22] Filed: Sep. 18, 1978

[51] Int. Cl.[2] ..... F23L 17/02

[52] U.S. Cl. ..... 98/59; 98/60; 98/66 R; 98/83

[58] Field of Search ..... 98/58–61, 98/66 R, 66 A, 70, 83, 84

[56] References Cited

U.S. PATENT DOCUMENTS

| | | | |
|---|---|---|---|
| 211,872 | 2/1879 | Van Noorden | 98/83 |
| 238,185 | 2/1881 | Van Noorden | 98/83 |
| 564,368 | 7/1896 | Esperson | 98/84 |
| 1,097,487 | 5/1914 | Van Auken | 98/84 |
| 1,097,487 | 5/1914 | Van Auken | 98/66 R |
| 1,283,374 | 10/1918 | Vaughn et al. | 98/66 R |
| 2,742,846 | 4/1956 | Alward | 98/84 |
| 2,922,354 | 1/1960 | Breidert | 98/84 |
| 2,933,036 | 4/1960 | Breidert | 98/84 |

*Primary Examiner*—Henry C. Yuen
*Attorney, Agent, or Firm*—Lane, Aitken & Ziems

[57] ABSTRACT

A chimney cowl has a vertically-spaced series of five annular vanes centered on a common vertical axis. The vanes are carried by three supports equi-spaced around the inner peripheries of the vanes, the supports mounting co-axially with said vanes and between the uppermost vane and the vane immediately subjacent thereto a device providing upper and lower aerofoils. The uppermost and lowermost vanes are parallel and are of frustoconical shape and the three intermediate vanes are parallel and are normal to the vertical axis of the vanes. The upper aerofoil is a wall of conical shape parallel to the uppermost vane and the lower aerofoil is a wall of inverted conical shape seating within and secured to the wall of the upper aerofoil. Means for clamping the cowl in position in a chimney outlet is provided.

4 Claims, 3 Drawing Figures

CHIMNEY COWLS

This invention relates to chimney cowls.

Heretofore, many attempts have been made to alleviate, in particular, downdrafts which occur in chimneys or flues (hereinafter in the specification and claims referred to as "chimneys") associated with both domestic and industrial fuel burning appliances. There have been produced a large number of devices, the devices for mounting onto or into the tops of such chimneys, ranging from a simple hollow conical device mounted over the chimney opening or mushroom shaped cowls to sophisticated aerodynamically designed vertical deflectors which have been used on industrial chimneys.

All these devices have many disadvantages, the most prominent one being that, in use, each contributes to back pressure within the chimney system and amounts to relatively little more than wind deflectors which tend to change the wind direction at the chimney outlet, but in no way make use of the wind energy in order to alleviate troublesome downdrafts.

According to the present invention, there is provided a chimney cowl comprising a series of annular vanes arranged in a predetermined spaced relationship centered on a common axis, the vanes being carried by a plurality of supports mounting co-axially with said vanes, and between two adjacent vanes a device having a conical or convexly dished outer wall masking the central apertures in said vanes, and means for clamping the cowl in position in or on a chimney, and means for clamping the cowl in position to a chimney outlet comprising at least two laterally extendable elongate members each having two ends, one end of each member being fixed to the lowermost vane, the other end of each member terminating in a union element, and an elbow between said ends, said union being movable vertically to cause movement of the elbows in a lateral direction towards or away from the chimney wall.

Preferably, the wall of the device has a skirt peripherally extending into the space between said two vanes.

Preferably also, the sum total of the areas between the vanes available for exhaustion of gases from the chimney is the same as or greater than the area of the chimney outlet.

The two vanes to be adjacent to the chimney when the cowl is fitted, are preferably arranged to form a venturi at their inner peripheries.

An embodiment of the present invention will now be described, by way of example, with reference to the accompanying drawings, in which.

Figure 1:
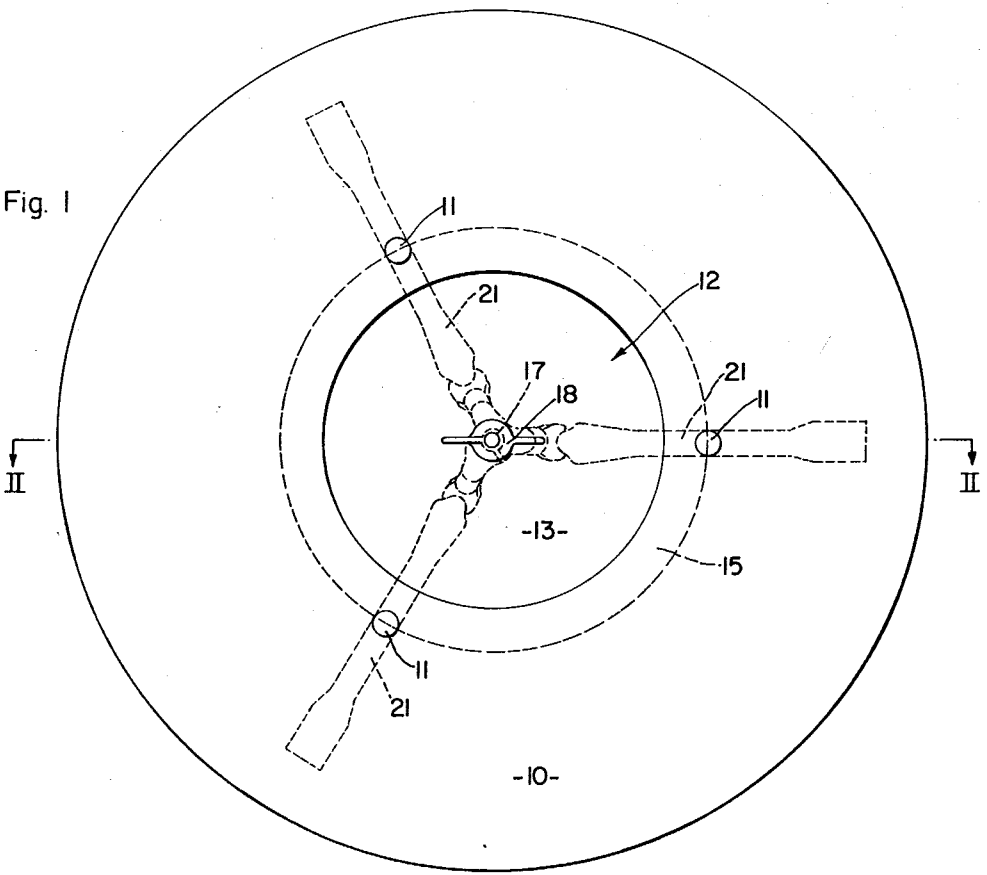
FIG. 1 is a plan view of a chimney cowl according to the present invention.

Referring to the drawings, a chimney cowl for fitment to a chimney to mask the outlet thereof is hereinafter described when fitted to the chimney. The cowl comprises a vertically spaced series of five annular vanes 10 centered on a common vertical axis. The vanes 10 are carried by a plurality of supports 11, three in the present embodiment, which are positioned at the inner peripheries of the vanes 10 and are at equally spaced intervals there around. The longitudinal axes of the supports 11 are parallel to the common vertical axis of the vanes 10. The uppermost and lowermost vanes 10 are parallel and are of frusto-conical shape, the angle to the horizontal being, for example, between 10° and 15°, and the three intermediate vanes 10 are parallel and are normal to the vertical axis of the vanes 10. The supports 11 mount co-axially with said vanes and between the uppermost vane 10 and the vane immediately subjacent thereto a device 12 providing two aerofoils 13 and 14. The aerofoil 13 is constituted by a conical outer or upper wall, parallel with the uppermost and lowermost vanes 10, and the aerofoil 14 is constituted by an inner or lower wall of inverted conical shape of base smaller than the conical shape of the wall 13 and which seats within and is secured to the wall 13. The device 12 masks from above the central apertures in the three intermediate vanes and lowermost vane 10. The aerofoil 13 has a skirt 15 which peripherally extends into the space between the uppermost vane and the vane intermediately subjacent thereto. The diameter at the base of the wall 14 is greater than the diameter at the base of the wall 13 to which it seats, for example, the angle to the horizontal of the wall 14 at its base is 20°, and of the wall 13 is 10°.

Means for clamping the cowl-in the chimney outlet 9 comprises three length-deformed elongate members 16 having similar ends fixed to the underside of the bottom vane 10, and the other similar ends formed into a union 20 and screw-threadedly engaged by an element in the form of a spindle 17 capped by a wing nut 18 secured thereto and by the bottom half of its circumference being screw-threaded and engaged with the union 20. The longitudinal axis of the spindle 17 lies along the vertical common axis of the vanes 10. The spindle 17 passes through both walls of the device 12 at their apices, and the nut 18 rests on top of the upper wall. Each member 16 is in three length portions, one portion 21 being fixed to the underside of the bottom vane 10, and being substantially parallel with the intermediate vanes 10. The supports 11 are rooted, one to each portion 21, to be upstanding therefrom. Portion 22 is bent relative to portion 21, and is at substantially right angles thereto before the clamping means is operated to clamp against the chimney. Portion 23 is reflexively bent back against portion 22 and its outer end is secured to the union 20. When the nut 18 is rotated anticlockwise, the union 20 is moved down the spindle 17 causing the bend or elbow 19 between the two portion 22 and 23 of each member 16 to move laterally into abutment against the chimney wall thereby to clamp the cowl in position. Clockwise rotation of the nut 18 unclamps the cowl by removing the elbows 19 out of abutment. The vanes 10 may each be provided with strengthening ribs running concentrically there around to the outer and inner peripheries thereof.

The above described chimney cowl has been designed on the principle that the energy of the wind can be used to alleviate the problem of downdrafts and is based on the well known venturi principle which in this case is used so that negative pressures are generated at the outlet 9 of the chimney under windy condition, irrespective of whether or not the wind direction is changing or whether the wind is discontinuous and is occurring in gusts.

The venturi is created between the bottom vane 10 and its immediate subjacent vane 10 at their inner peripheries due to the convergence of said vanes 10 as hereinbefore described whereby acceleration of airflow is created. Above the venturi is an expansion chamber which occupies the space defined centrally of the vanes, nd is topped by the lower aerofoil 14 of the device 12. This aerofoil 14 reduces the negative pressure within he cowl even further and smooths the airflow through he cowl. The upper aerofoil 13 denies access to the himney of rain, snow, hail, and birds.

Once clamped in position in the chimney outlet, the ngles of the vanes 10 and aerofoil 13 and 14 prevent lowndrafts entering the chimney directly from any ngle. The downdrafts are deflected by the vanes 10 cross the chimney outlet and in this way are converted nto laminar airflow through the cowl, flowing from ne side to the other. If we look at FIG. 2, airflow from eft to right, at outlet level, is deflected upwards by the ottom vane 10 and compressed and accelerated in the enturi formed by the vanes 10 as hereinbefore decribed. This caused a reduction in the pressure of the ir above the chimney outlet causing better extraction f gases from the chimney. The position of portion 21 ets the distance of the lowermost vane 10 from the rim f the chimney outlet and leaves an annular gap through hich the venturi can draw air if required.

Airflow above between the other vanes 10 enters the xpansion chamber causing, again a fall in air pressure nd this is increased by the airflow passing over the nverted aerofoil.

This reduces chimney outlet pressures even further, gain enhancing gas extraction. The size and position of he vanes 10 prevents rain and bird access to the chimey outlet.

The outlet areas of the cowl available for exhaustion f gases from the chimney are such that the sum total hereof is the same as or greater than the area of the himney outlet. This is calculated by a mathematical ormula, as follows:

$$\pi r^2 = \pi d \times tw$$

where r is the radius of the chimney outlet d is the diameter of the aperture in the center of the vanes, and tw is the total height available for exhaustion of gases and this comprises i. The distance between the circumference of the flue orifice and the closest point to it of the underside of the lowest vane. Plus ii. The sum of the distance between each vane up to the vane immediately below the aerofoil 14, measured at the circumference of the central vane aperture. Plus iii. The distance between the circumference of the central aperture of the vane immediately below the aerofoil and the nearest point on the outer edge or circumference of the skirt of the aerofoil.

The outer diameter of the vanes 10 and the diameter f the apertures in the vanes 10 are governed by the size f the chimney outlet 9, and therefore a variety of sizes f cowls can be provided to suit with the different sizes f chimney outlets in use.

Figure 2:
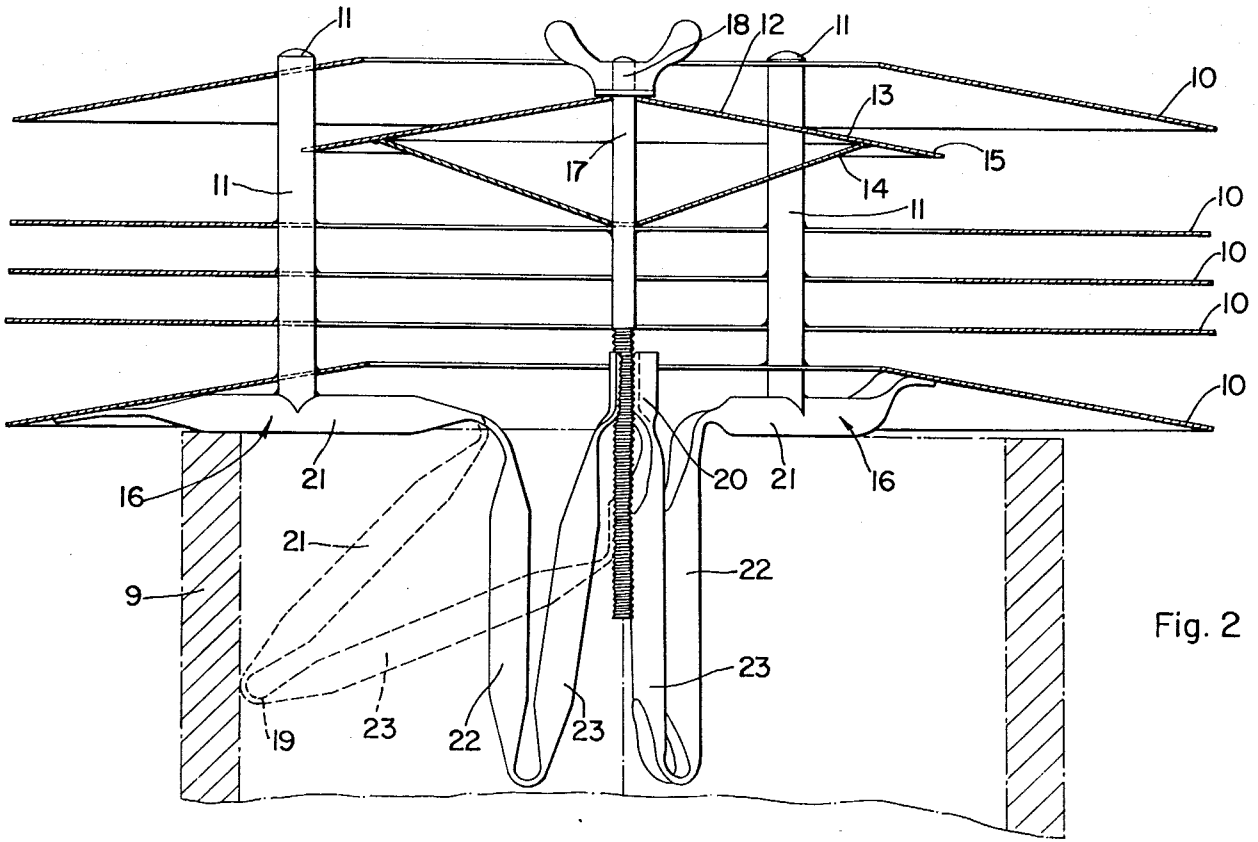
FIG. 2 is a cross section on the line II—II of FIG. 1 to a slightly larger scale.
Figure 3:
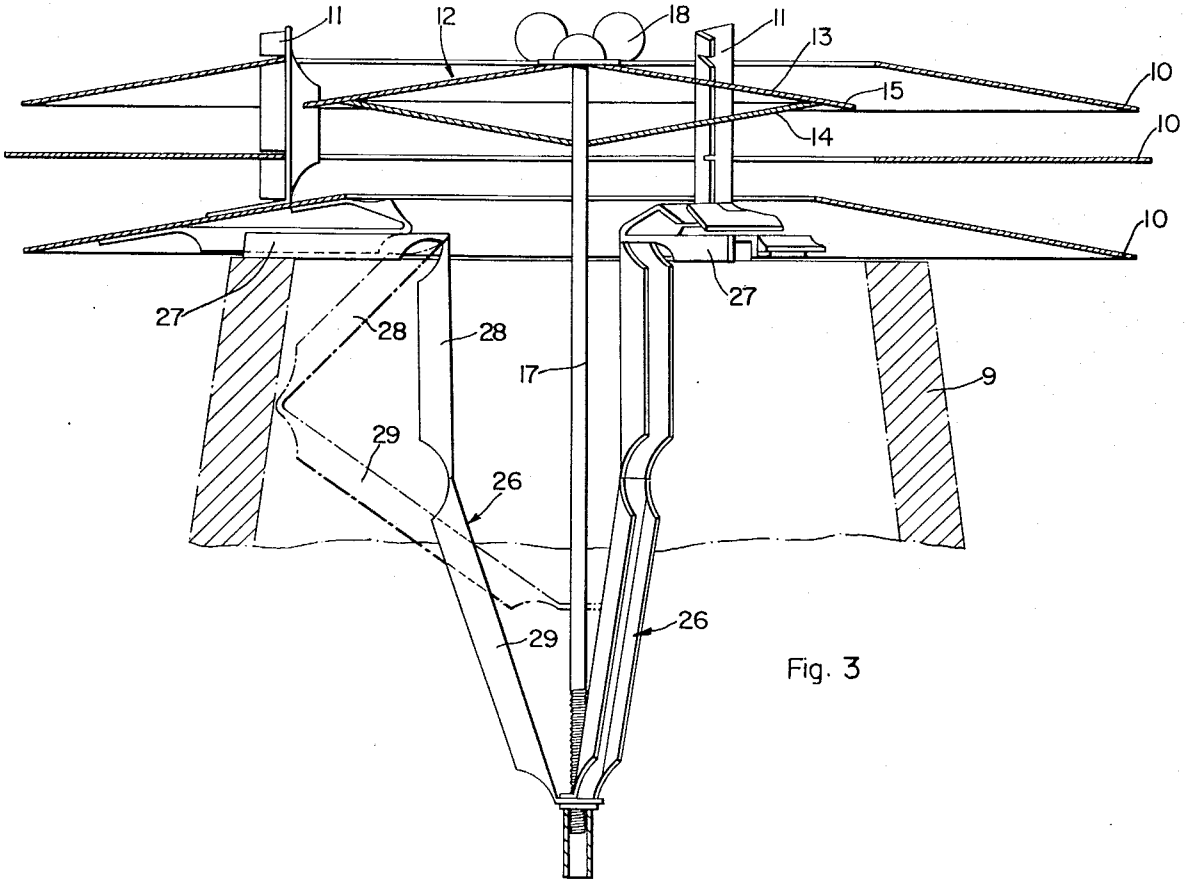
FIG. 3 is a cross sectional view of a modified chimney cowl.

Other clamping means can be used to clamp the cowl n position but the one shown in FIG. 2 has been found to be simple and effective in use and most convenient for packaging purposes. A different clamping means is shown in FIG. 3 comprising three length deformable elongate members 26, each having three portions 27, 28, and 29. Portions 28 and 29 are similarly positioned as are portions 21 and 22 in the above embodiment, but portion 29 extends downwardly from portion 28 to terminate in a union in screw-threaded engagement with a spindle, longer than spindle 17 of the above embodiment. The rotation of the nut on the spindle operates in reverse i.e. clockwise rotation causes deformation of the portions 28 and 29 to form a bend or elbow to abut against the chimney. FIG. 3 also shows only one intermediate vane 10. Any number of intermediate vanes 10 can be used without departing from the scope of the invention. The cowls of the above-described invention can be used with chimney pots, or on chimneys without any pots.

The material of construction can be mild steel which can be made corrosion proof by the use of surface coatings such as epoxy resins, PTFE, or pure sprayed aluminium. Other materials of construction will be apparent to those skilled in the art; examples of such materials are stainless steel and high purity aluminium.

The ribs may be radial rather than concentric and the aerofoils 13 and 14 may be convexly and concavely dished respectively.

I claim:

1. A chimney cowl comprising a series of annular vanes lying in horizontal planes, central apertures in said vanes, a common axis about which the vanes are centered and arranged in predetermined spaced relationship, a plurality of supports, an annular device mounted coaxially with said vanes and between two adjacent vanes that, when the cowl is fitted to a chimney outlet, are remote from the chimney outlet, the device masking the central apertures in said vanes, means for clamping the cowl in position to a chimney outlet comprising at least two laterally extending elongate members each having two ends, one end of each member being fixed to the lowermost vane, the other end of each member terminating in a union element, and an elbow between said ends, said union being movable vertically to cause movement of the elbows in a lateral direction towards or away from the chimney wall.

2. A chimney cowl according to claim 1 wherein a skirt peripherally extends around an outer wall of the masking device and into the space between said two vanes.

3. A chimney cowl according to claim 1 wherein the sum total of the areas available for exhaustion of the gases from the cowl is the same as or greater than the area of the chimney outlet.

4. A chimney cowl according to claim 1 wherein two vanes to be adjacent to the chimney when the cowl is fitted, converge towards their centers to form a venturi at their inner peripheries.

* * * * *